US008881717B2

(12) United States Patent
Yi

(10) Patent No.: US 8,881,717 B2
(45) Date of Patent: Nov. 11, 2014

(54) BUILT-IN COOKING APPLIANCE

(75) Inventor: Soo Cheol Yi, Changwon (KR)

(73) Assignee: LG Electronics Inc., Seoul (KR)

( * ) Notice: Subject to any disclaimer, the term of this patent is extended or adjusted under 35 U.S.C. 154(b) by 1299 days.

(21) Appl. No.: 12/448,725

(22) PCT Filed: Nov. 15, 2007

(86) PCT No.: PCT/KR2007/005757

§ 371 (c)(1),
(2), (4) Date: Jan. 22, 2010

(87) PCT Pub. No.: WO2008/082075

PCT Pub. Date: Jul. 10, 2008

(65) Prior Publication Data

US 2010/0132688 A1 Jun. 3, 2010

(30) Foreign Application Priority Data

Jan. 5, 2007 (KR) ..... 10-2007-0001222
Jan. 9, 2007 (KR) ..... 10-2007-0002603

(51) Int. Cl.
*F24C 15/30* (2006.01)
*F24C 15/10* (2006.01)

(52) U.S. Cl.
CPC ..... *F24C 15/30* (2013.01); *F24C 15/101* (2013.01)
USPC ..... 126/1 R; 126/211; 126/214 A; 126/39 H; 126/299 D; 219/432; 219/450.1

(58) Field of Classification Search
USPC ..... 126/1 R, 211, 214 A, 39 H, 299 D, 37 R, 126/19 R, 273 R; 219/432, 450.1, 445.1, 219/452.11
See application file for complete search history.

(56) References Cited

U.S. PATENT DOCUMENTS

| | | | | |
|---|---|---|---|---|
| 3,797,375 | A * | 3/1974 | Cerola | 99/340 |
| 6,297,482 | B1 | 10/2001 | Becker | |
| 2006/0144388 | A1 * | 7/2006 | Hosoi et al. | 126/214 A |

FOREIGN PATENT DOCUMENTS

| | | | |
|---|---|---|---|
| CN | 1723368 | | 1/2006 |
| JP | 57-182014 | | 11/1982 |
| JP | 03-122990 | | 5/1991 |
| JP | 05-121155 | | 6/1993 |
| JP | 6-005358 | | 1/1994 |
| JP | 2-690156 | | 12/1997 |
| JP | 2005-265209 | A | 9/2005 |
| JP | 2006-322645 | | 11/2006 |
| KR | 10-2004-0049779 | A | 6/2004 |
| RU | 42943 | U1 | 12/2004 |

* cited by examiner

*Primary Examiner* — Avinash Savani
(74) *Attorney, Agent, or Firm* — McKenna Long & Aldridge LLP

(57) ABSTRACT

A built-in cooking appliance includes a top plate, a main body provided under the top plate and receiving a heat source, a cabinet on which the top plate is installed, a top cover covering a space defined between a side cover of the top plate and the cabinet, an air outlet formed on the main body, a cover airflow hole provided on the top corner and providing a path along which the air discharged through the air outlet is discharged to an external side, and a storage space provided on a path an airflow path between the air outlet and the cover airflow hole and storing water introduced through the cover airflow hole.

15 Claims, 5 Drawing Sheets

BUILT-IN COOKING APPLIANCE

This application claims the benefit of PCT/KR2007/005757 filed on Nov. 15, 2007, and Korean Patent Application Nos. 10-2007-0001222 and 10-2007-0002603 filed on Jan. 5, 2007 and Jan. 9, 2007 respectively, the contents of which are hereby incorporated herein by reference for all purposes in their entirety.

TECHNICAL FIELD

This document relates to a built-in cooking appliance and, more particularly, to a built-in cooking appliance having a top plate on which food is cooked.

BACKGROUND ART

A built-in cooking appliance is a kitchen appliance installed on a cabinet. That is, the built-in cooking appliance is associated with kitchen furniture so that a user can conveniently use the same. The built-in cooking appliance makes the interior of the kitchen beautiful.

In recent years, a built-in cooking appliance having a top plate, which can cook the food using heat transmitted to the food through the top plate, has been developed. Such a built-in cooking appliance having the top plate is called a hot plate, a hob, a range, or a cook-top. Regardless of the name, a concept of the present invention may be applied to any cooking appliances having the top plate. In the following description, a terminology "cooking appliance" means a cooker having the top plate.

In order to operate components under a thermally-stable state, a typical cooking appliance is designed such that air flows in and out of the cooking appliance. To realize this, the top plate is mounted protruding above the top surface of the top plate by a predetermined height. In this case, it is difficult to clean a portion around the top plate and an outer appearance is deteriorated.

*In the typical cooking appliance, water may flow into a main body of the cooking appliance through an air passage hole formed on the top plate or a portion around the top plate. The water flowing into the main body of the cooking appliance may cause a short circuit or malfunction of the cooking appliance. This problem must be most considered in designing the cooking appliance as the cooking appliance is used in the kitchen where the water is frequently used.

DISCLOSURE OF INVENTION

Technical Problem

Embodiments provide a built-in cooking appliance that is configured to allow air to be introduced or discharged through a top plate while preventing water from inflowing a cooker, thereby improving reliability of the cooker.

Embodiments also provide a built-in cooking appliance that is configured to improve its outer appearance by disposing a top plate and a cabinet on a same horizontal plan and to conveniently install the cooker.

Technical Solution

In one embodiment, a built-in cooking appliance includes a top plate; a main body provided under the top plate and receiving a heat source; a cabinet on which the top plate is installed; a top cover covering a space defined between a side cover of the top plate and the cabinet; an air outlet formed on the main body; a cover airflow hole provided on the top corner and providing a path along which the air discharged through the air outlet is discharged to an external side; and a storage space provided on a path an airflow path between the air outlet and the cover airflow hole and storing water introduced through the cover airflow hole.

In another embodiment, a built-in cooking appliance includes a top plate; a main body provided under the top plate and provided with an air outlet for discharging internal hot air; a cabinet having a top surface on which at least one side corner of the top plate seats; a top cover covering a space defined between a side corner of the top plate and the cabinet; a cover airflow hole that is provided on the top cover to provide a path along which air flows; and an airflow guide shielding an inner space of the cabinet from an airflow path connecting the air outlet to the cover airflow hole.

In still another embodiment, a built-in cooking appliance includes a top plate; a main body disposed under the top plate and receiving a heater; a cabinet on which the top plate is installed; a support supporting the top plate against the cabinet; an air outlet that is provided on the main body to discharge air out of the main body; a support airflow hole that is formed on the support to allow the air discharged through the air outlet to pass; and a storage space that is formed on the support to temporarily store water introduced from an external side.

Advantageous Effects

According to the embodiments, operational reliability of the cooker can be improved and the installation of the cooker can be easily performed.

BEST MODE FOR CARRYING OUT THE INVENTION

Reference will now be made in detail to the embodiments of the present disclosure, examples of which are illustrated in the accompanying drawings.

First Embodiment

Figure 1:
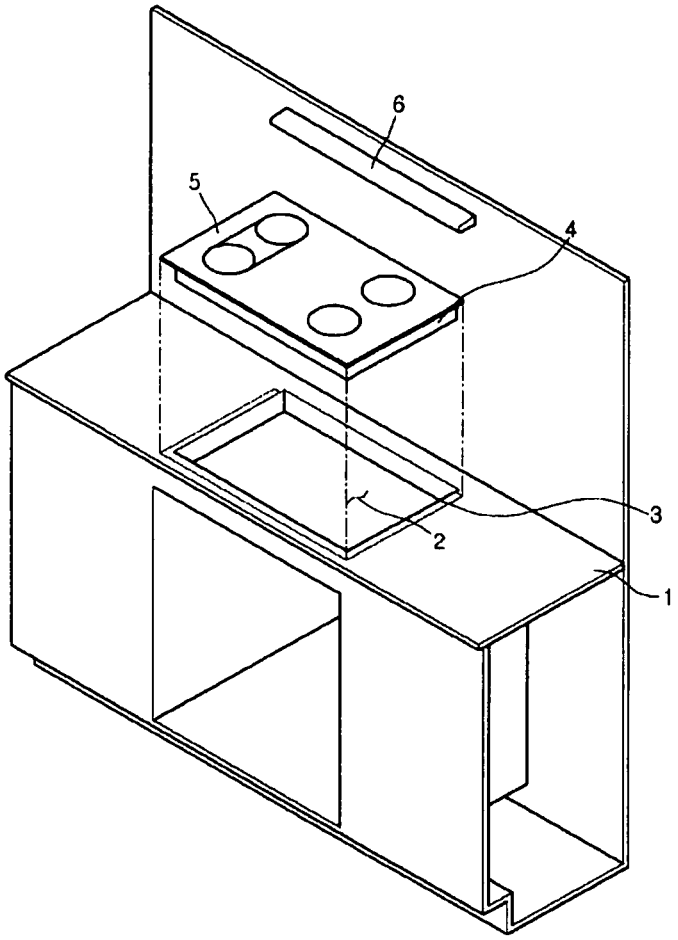
FIG. 1 is a perspective view of a built-in cooking appliance according to an embodiment, when a cooker is being installed.
Figure 2:
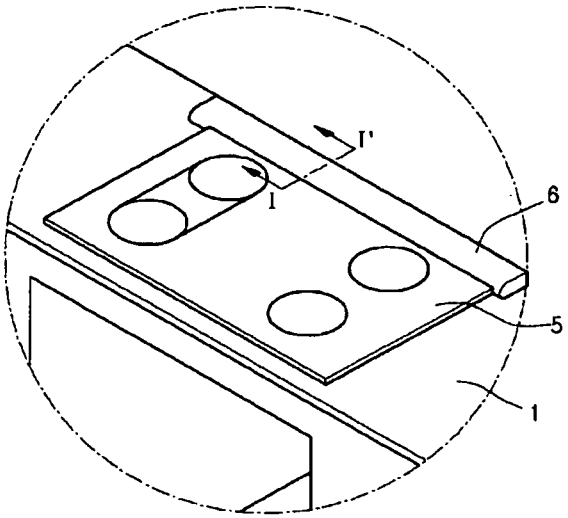
FIG. 2 is a perspective view of the built-in cooking appliance of FIG. 1, when the cooker is completely installed.

FIG. 1 is a perspective view of a built-in cooking appliance according to an embodiment, when a cooker is being installed and FIG. 2 is a perspective view of the built-in cooking appliance of FIG. 1, when the cooker is completely installed.

Referring to FIGS. 1 and 2, a built-in cooking appliance of this embodiment includes a cabinet 1, a receiving portion 2 depressed from a top surface of the cabinet 1 and partly receiving a cooker, a seating portion 3 defined by an outer edge portion of the receiving portion, a main body 4 partly received in the receiving portion 2, a top plate 5 provided on an upper end of the main body 4, and a top cover 6 for covering a space defined between the top plate 5 and the cabinet 1.

The following will describe operation of the components.

The main body 4 is fixed to the top plate 5 by a top surface thereof adhered to an under surface of the top plate 5. A variety of components operating the cooker are installed in the main body 4.

An edge portion of the top plate 5 seats on the seating portion 3. Adhesive may be provided between the edge portion of the top plate 5 and the seating portion 3 to securely fix the top plate 5 on the seating portion 3. Alternatively, the edge portion of the top plate 5 simply seats on the seating portion 3 without using any coupling member. In this case, a support is provided to fixedly support at least one surface of the top plate. Alternatively, a sealing member may be provided between the edge portion of the top plate 5 and the seating portion 3 to prevent water from being introduced into the cooker.

Further, a rear corner of the top plate 5 may be spaced apart from the cabinet 1 to provide an airflow space. As a result, hot air can be discharged out of the main body 4 through the space defined between the rear corer of the top plate and the cabinet 1.

The under surface of the top plate 5 is located on a same horizontal plan with a top surface of the cabinet 1 so that the cleaning can be easily performed.

Figure 3:
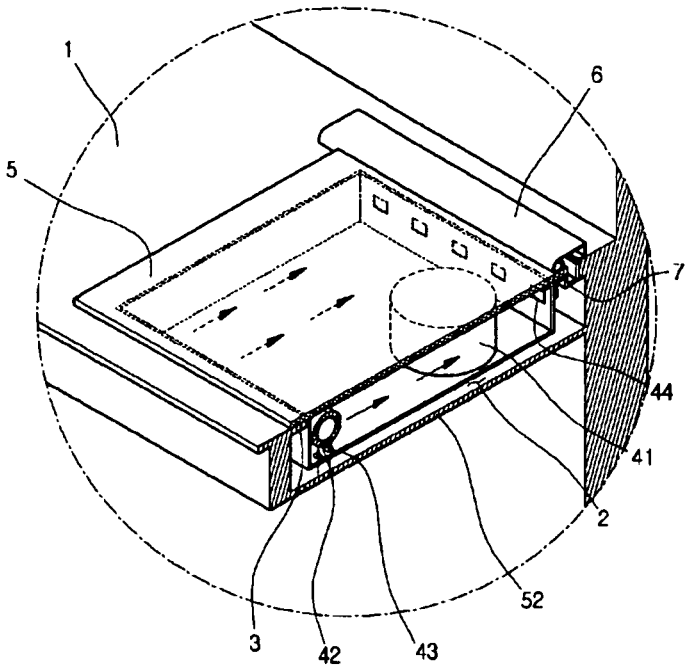
FIG. 3 is a partly broken perspective view of the built-in cooking appliance of FIG. 1.

FIG. 3 is a partly broken perspective view of the built-in cooking appliance of FIG. 1.

Referring to FIG. 3, as the under surface of the top plate 5 is located on a same horizontal plan with a top surface of the cabinet 1, the cleaning can be easily performed and the overall volume can be reduced. As the rear corner of the top plate 5 may be spaced apart from the cabinet 1 to provide the airflow space, the hot air can be discharged out of the main body 4 through the airflow space.

The internal structure of the main body 4 will now be described.

First, a fan 42 is received in the main body 4 to introduce external air into the main body 4 through an air inlet 43. The introduced air cool a variety of heat generating elements such as a heater 41 to operate the components of the cooker under a thermally-stable state. The air used for cooling the components is discharged through an air outlet 44 formed on a rear corner surface of the main body 4.

The air discharged through the air outlet 44 is discharged through an airflow hole (71 in FIG. 4) formed on the support 7 and further discharged to an external side through a cover airflow hole 61.

Figure 4:
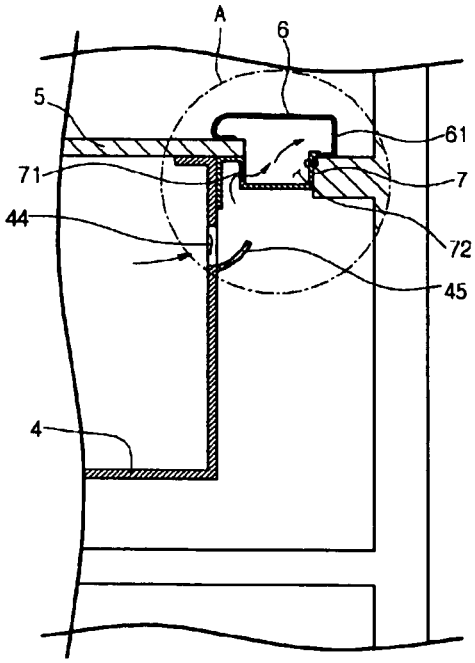
FIG. 4 is a sectional view taken along line I-I' of FIG. 2.

FIG. 4 is a sectional view taken along line I-I' of FIG. 2.

Referring to FIG. 4, the air introduced by the fan 42 and heated in the main body 4 is discharged through the air outlet 44. In order not to disperse the air but to directly discharge the air the external side, an airflow guide 45 inclined toward the support airflow hole 71 is formed behind the air outlet 44. The airflow guide 45 may be formed by being cut and bent from the main body 4. Alternatively, the airflow guide 45 may be formed of a separate plate. In this case, the separate plate is coupled to the main body 4.

After the airflow is guided by the airflow guide 45, the air is discharged through the support airflow hole 71. The discharged air is discharged to the external side through the cover airflow hole 61 formed on a rear portion of the top cover 6. The receiving portion 2 is blocked by the cabinet 1. That is, a bottom of the receiving portion 2 is not opened to an external space. Therefore, the components disposed in the main body 4 are not affected by a pressure difference generated when a door provided on a front portion of a space under the receiving portion 2 is opened and closed. The external air may be introduced through clearances formed on the cabinet. However, even when the bottom of the receiving portion 2 is opened, the cooker can be normally operated.

The support 7 may be screw-coupled to a side surface of the main body or adhered to the under surface of the top plate 5. The support 7 may be adhered to or screw-coupled to the cabinet 1.

A portion where the top cover 6 is aligned with the top plate 5 may be adhered to a portion where the top cover 6 is aligned with the cabinet 1.

Meanwhile, the air may be discharged to the external side through an air passage defined by the air outlet 44, the support airflow hole 71, and the cover airflow hole 61, which are aligned with each other. In this case, water, however, may be introduced through the air passage. This problem must be solved as the cooker is used in the kitchen where water is frequently used.

To solve the problem, the cover airflow hole 61 is formed at a location higher that the top surface of the cabinet 1. Then, even when the water is introduced, the water flow can be blocked by a wall defined under the cover airflow hole 61. If the water overflows the cover airflow hole 61, the overflowing water is collected in a storage space 72 formed by bending the support 7. Therefore, the water cannot be introduced into the main body 4.

Figure 5:
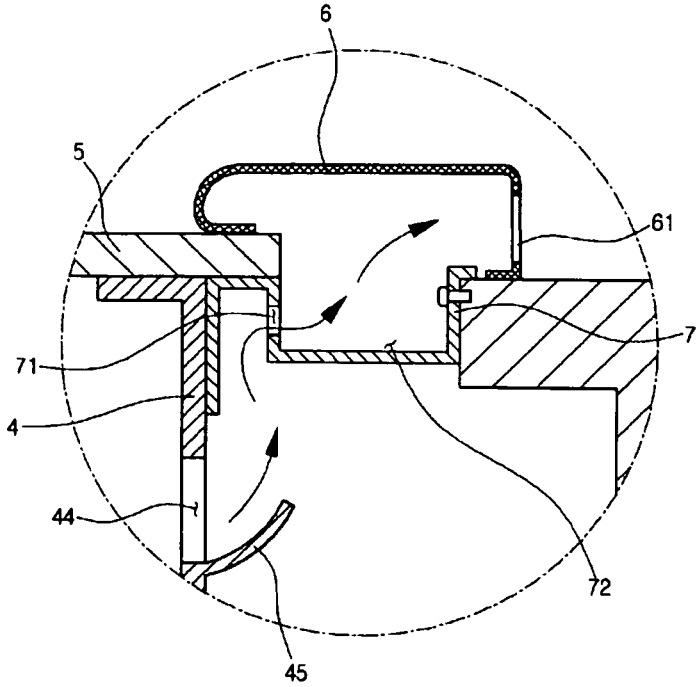
FIG. 5 is an enlarged view of a portion A of FIG. 4, illustrating air discharging process.
Figure 6:
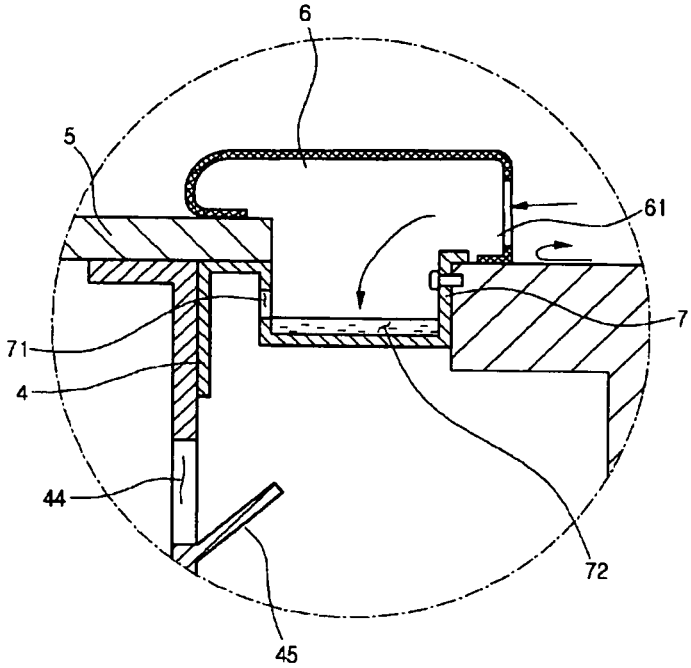
FIG. 6 is an enlarged view of a portion A of FIG. 4, illustrating water blocking process.

FIG. 5 is an enlarged view of a portion A of FIG. 4, illustrating air discharging process, and FIG. 6 is an enlarged view of a portion A of FIG. 4, illustrating water blocking process.

Referring to FIG. 5, the air discharged through the air outlet 44 is guided by the airflow guide 45 and passes through the support airflow hole 71, after which the air is discharged to the external side through the cover airflow hole 61 formed on the top cover 6.

Referring to FIG. 6, even when there is water around the cooker, the water cannot inflow through the cover airflow hole 61 by the wall of the top cover 6. When the water overflows into the cooker through the cover airflow hole 61 is collected in the storage space 72. Therefore, the water is not introduced into the main body 4. The water collected in the storage space 72 may be vaporized by heat generated by the operation of the cooker.

According to the above-described built-in cooking appliance of this embodiment, the hot air is effectively discharged to the external side while the external water is not introduced into the main body. Therefore, the user convenience is improved and the operational reliability of the cooker can be enhanced.

The following will describe a modified example of the embodiment.

First, in the above embodiment, the top cover 6 functions to cover a space defined between the rear cover of the top plate and the cabinet. However, the present invention is not limited to this configuration. For example, the top cover 6 may be provided on any edge portion formed spacing the top plate from the cabinet.

Further, the cooker may be coupled to the cabinet in a state where the supports 7 are provided on the respective corners of the top plate.

As described above, the storage space 72 stores the water introduced through the cover airflow hole 61 from the external side. Therefore, the water cannot be introduced into the main body.

The storage space 72 is provided in the form of rectangular box. However, the present invention is not limited to this configuration. For example, the storage space 72 may have a rounded bottom or may be inclined downward as it goes rearward.

In order to allow the air guided by the airflow guide 45 to be effectively discharged through the support 7, the support airflow hole 71 may be formed not to be oriented leftward but to face the airflow guide 45. In this case, a surface of the support 7, on which the support airflow hole 71 is formed, may be inclined toward the airflow guide 45.

When the support 7 extends up to the top surface of the cabinet 1, the inflowing of the external water can be further prevented. When the cover airflow hole 61 is formed at a location above a predetermined height, the water blocking reliability can be enhanced. Therefore, the extending of the support 7 to the top surface of the cabinet 1 is not essentially required. The support may be coupled to a side surface of the cabinet by, for example, a screw.

In this embodiment, the water storage space is formed on the support. However, the present invention is not limited to this embodiment. For example, the water storage space may be formed on other portions.

Second Embodiment

In the following description, like reference numerals denote like elements throughout the drawings of the first and second embodiments. Only different elements from the first embodiment will be described in this embodiment.

Figure 7:
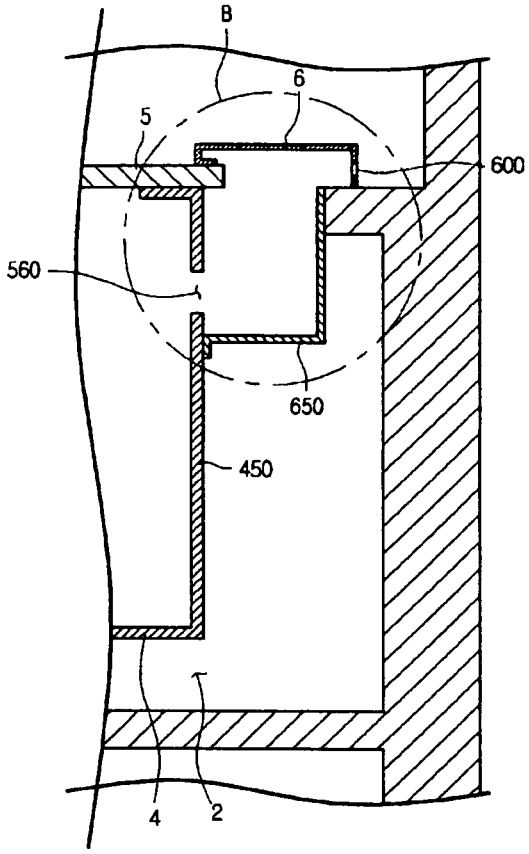
FIG. 7 is a partial sectional view of a built-in cooking appliance according to a second embodiment.

FIG. 7 is a partial sectional view of a built-in cooking appliance according to a second embodiment.

Referring to FIG. 7, the air is introduced by the fan 42 and heated in the main body. The hot air is discharged to the external side. At this point, it is important not to direct the hot air to the receiving portion 2. If the hot air is directed to the receiving portion 2, the discharged air may be introduced again into the main body 4 through the air inlet 43. Then, the air is overheated in the main body 4. In this case, the components in the main body may operate under a thermally unstable state.

In order to prevent the above problem, an airflow guide 650 connecting a portion of a rear wall of the main body 4 under an air outlet 560 to the cabinet 1 is further provided. Therefore, the air discharged through the air outlet 560 is not directed to the receiving portion 2 but guided by the air outlet 650 to be discharged to the external side through the space defined between the top plate 5 and the cabinet 1.

The air discharged through the space between the top plate 5 and the cabinet 1 is guided rearward by the top cover 6 and discharged rearward through the cover airflow hole 61.

Figure 8:
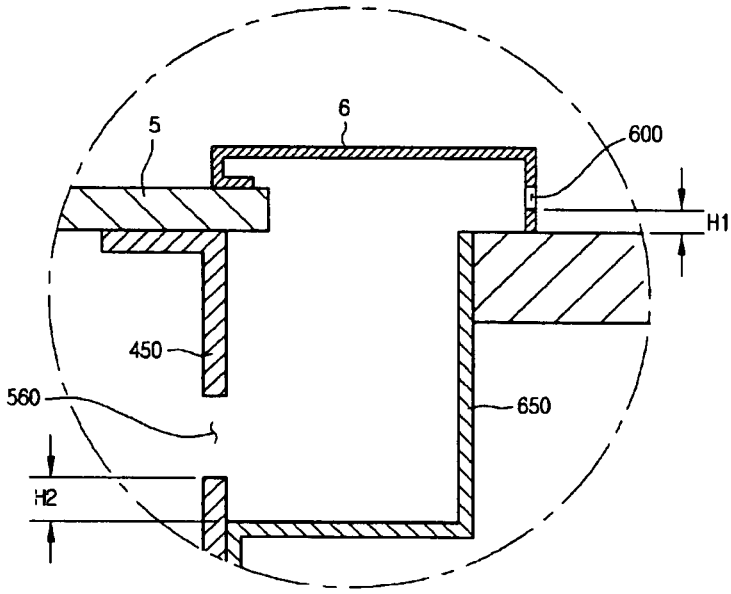
FIG. 8 is an enlarged view of a portion B of FIG. 6.

FIG. 8 is an enlarged view of a portion B of FIG. 7.

Referring to FIG. 8, the rear wall 450 of the main body 4 extends upward and is adhered to the under surface of the top plate 5. The air outlet 560 through which the hot air is discharged out of the main body 4 is formed on an upper portion of the rear wall 450. The hot air discharged through the air outlet 560 is guided upward. To realize this, an airflow guide 650 having a first end connected to a portion below the air outlet 560 and a second end contacting the cabinet 1.

The airflow guide 650 is independent from the main body 4 and formed of heat-resistant plastic. When installing the airflow guide 650, the airflow guide 650 is first coupled to the main body and the second end contacts the cabinet 1 when the cooker is installed in the receiving portion 2. That is, there is no need to securely couple the airflow guide 650 to the cabinet 1.

The hot air is guided upward by the airflow guide 650 and further guided rearward by the top cover 6. Subsequently, the hot air is discharged to the external side through the cover airflow hole 61.

By the above-described structure, the hot air is not directed to the receiving portion 2 and the main body 4 but effectively discharged out of the cooker.

However, the external water may be introduced into the cooker by the air discharged structure.

In order to solve this problem, this embodiment proposes a water blocking structure.

First, the cover airflow hole 61 of the top cover 6 is formed at a predetermined height. That is, the cover airflow hole 61 is provided above the cabinet 1 at a predetermined height H1. Therefore, a portion of the top cover 6 under the cover airflow hole 61 functions as a barrier for preventing the water from being introduced. By this barrier, the introduction of the water from the external side can be primarily prevented.

However, when the water overflows through the cover airflow hole 61, the overflowing water may be stored in the airflow guide 650. That is, when the water is introduced through a space between the rear end of the top plate 5 and the cabinet 1, the water is first stored in the airflow guide 650 not to be introduced. To realize this, the connecting portion between the air outlet 560 and the airflow guide 650 is formed having a predetermined height H2. As described above, the airflow guide 650 functions to effectively discharge the air as well as to prevent the water from being introduced into the main body.

The water stored in the airflow guide 650 is vaporized by heat generated by the cooker or by the air flowing along the airflow guide 650.

According to the built-in appliance of this second embodiment, the hot air in the main body does not flow back but can be effectively discharged. In addition, the introduction of the external water into the main body can be effectively prevented. Therefore, the user convenience is improved and the operational reliability of the cooker can be enhanced. Further, the installation of the airflow guide can be naturally realized during the installation of the cooker on the cabinet, thereby improving the installation convenience.

Third Embodiment

A third embodiment is identical to the second embodiment except for the structure of the airflow guide. Therefore, only different structure from the first embodiment will be described in this embodiment.

Figure 9:
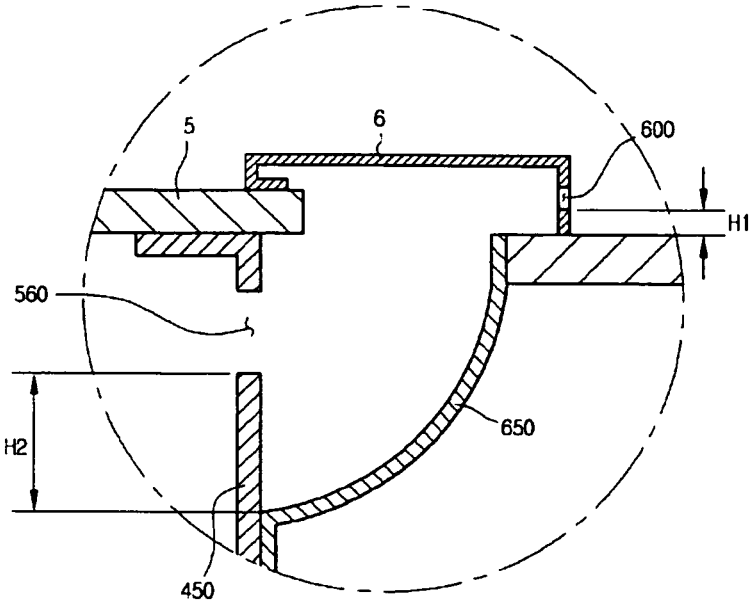
FIG. 9 is a partly broken perspective view of a built-in cooking appliance according to a third embodiment.

FIG. 9 is a partly broken perspective view of a built-in cooking appliance according to a third embodiment.

Referring to FIG. 9, an airflow guide of this embodiment is gently curved so that the air can be stably discharged through the air outlet 560. That is, since the air discharged rearward through the air outlet can be gently guided upward, the air can be stably discharged.

The following will describe possible modified examples of the second and third embodiments.

Front and both side surfaces of the top plate are supported by the cabinet. In this case, although the top plate can be supported, a support may further provided between a rear surface of the top late and the cabinet to more securely support the top plate. In this case, the support is not limited to a specific structure but an opening through which the air is discharged out of the main body is provided.

In addition, the airflow guide may be formed of metal. When the airflow guide is formed of metal, when a first end of the airflow guide is coupled to the rear wall 450 and the cooker is installed, a second end of the airflow guide is elastically deformed while contacting the cabinet, thereby enhancing the sealing effect at the contact portion.

Further, the main body is supported only on the top plate or on a side surface of the cabinet. For example, the main body extends sideward to be interposed between the top plate and the cabinet. In this case, the self-gravity of the main body can be stably supported.

In addition, a support having a first side supported on of the main body or the top plate and a second side supported on the cabinet may be further provided to more stably support the cooker.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

According to the built-in cooking appliance of the present invention, the hot air is effectively discharged out of the cooker while the introduction of the water can be prevented. Therefore, the operational reliability of the cooker can be improved. In addition, the installation of the cooker can be effectively realized.

The invention claimed is:

1. A built-in cooking appliance comprising:

a top plate, at least a portion of the top plate seated on a cabinet;

a main body provided under the top plate and receiving a heat source, the main body including a bottom wall, a side wall extended upward from the bottom wall, and a flange extended from the side wall in a horizontal direction to support a lower surface of the top plate;

a top cover covering a space defined between a side edge of the top plate and the cabinet;

an air outlet formed on the main body;

a cover airflow hole provided on the top cover and providing a path along which the air discharged through the air outlet is discharged to an external side;

a support configured to couple the top plate to the cabinet, the support disposed between the side wall and the cabinet;

a support airflow hole formed on the support for forming flow passage of the air discharged through the air outlet; and a storage space provided on an airflow path between the air outlet and the cover airflow hole and storing water introduced through the cover airflow hole, wherein the air discharged from the air outlet flows to the cover flow hole, after flowing through a space defined between an outer surface of the side wall of the main body and the cabinet.

2. The built-in cooking appliance according to claim 1, wherein the storage space is formed on the support.

3. The built-in cooking appliance according to claim 1, wherein at least one side edge of the top plate is directly supported on the cabinet.

4. The built-in cooking appliance according to claim 1, further comprising an airflow guide for directing the air discharged through the air outlet toward the cover airflow hole.

5. The built-in cooking appliance according to claim 1, wherein the cover airflow hole is formed above the cabinet.

6. The built-in cooking appliance according to claim 1, wherein an under surface of the top plate is aligned with a top surface of the cabinet.

7. A built-in cooking appliance comprising:

a top plate, at least one side corner of the top plate seated on a top surface of a cabinet;

a main body provided under the top plate, including a bottom wall, a side wall extended upward from the bottom wall, and a flange extended from the side wall in a horizontal direction to support a lower surface of the top plate, the side wall provided with an air outlet for discharging internal hot air;

a top cover covering a space defined between a side corner of the top plate and the cabinet;

a cover airflow hole that is provided on the top cover to provide a path along which air flows; and an airflow guide configured to guide the air discharged from the air outlet to the cover airflow hole, wherein the airflow guide connects an outer surface of the side wall of the main body to the cabinet, and wherein a first end of the airflow guide is coupled to a portion lower than the air outlet such that the airflow guide defines a water storage space, wherein the water storage space is defined by an inner surface of the airflow guide and the outer surface of the side wall of the main body.

8. The built-in cooking appliance according to claim 7, wherein the airflow guide is independent from the main body.

9. The built-in cooking appliance according to claim 7, wherein the airflow guide is curved.

10. A built-in cooking appliance comprising:

a top plate, a lower surface of the top plate seated on a cabinet;

a main body disposed under the top plate and receiving a heater, the main body having a first portion, a second portion extended upward from the first portion, and a third portion extended from the second portion in a horizontal direction to support the top plate;

a support configured to support the top plate against the cabinet, the support disposed between an outer surface of the second portion and the cabinet;

an air outlet that is provided on the second portion of the main body to discharge air out of the main body;

a support airflow hole that is formed on the support to allow the air discharged through the air outlet to pass;

a storage space that is formed on the support to temporarily store water introduced from an external side;

a top cover covering a space defined between a side edge of the top plate and the cabinet; and a cover airflow hole provided on the top cover and providing a path along which the air discharged through the air outlet flows, wherein the air discharged from the air outlet flows to the cover airflow hole, after flowing through a space defined between an outer surface of the second portion of the main body and the cabinet.

11. The built-in cooking appliance according to claim 10, wherein the storage space is located in a space defined between the top plate and the cabinet.

12. The built-in cooking appliance according to claim 10, wherein an upper surface of the top plate is aligned with a top surface of the cabinet.

13. The built-in cooking appliance according to claim 10, wherein at least one surface of the top plate seats on a top surface of the cabinet.

14. The built-in cooking appliance according to claim 10, wherein the support is mounted in a space spaced apart in a left-right direction between the top plate and the cabinet.

15. The built-in cooking appliance according to claim 1, wherein a bottom surface forming the storage space is located above the air outlet of the main body.

* * * * *